US006622313B1

(12) United States Patent
Choi et al.

(10) Patent No.: US 6,622,313 B1
(45) Date of Patent: Sep. 23, 2003

(54) ROTATABLE COUPLING STRUCTURE FOR SHIELD AND VISOR OF HELMET

(75) Inventors: Kwang-Moon Choi, Suwon-si (KR); Young-Il Kim, Gunpo-si (KR); Jeong-Hwan Park, Yongin-si (KR)

(73) Assignee: Hong-Jin Crown Co., Ltd., Kyunggi-do (KR)

( * ) Notice: Subject to any disclaimer, the term of this patent is extended or adjusted under 35 U.S.C. 154(b) by 0 days.

(21) Appl. No.: 10/143,530

(22) Filed: May 9, 2002

(30) Foreign Application Priority Data

Apr. 2, 2002 (KR) ..... 2002-0017961

(51) Int. Cl.[7] ..... A42B 1/08
(52) U.S. Cl. ..... 2/424; 2/12
(58) Field of Search ..... 2/424, 425, 422, 2/10, 12, 410

(56) References Cited

U.S. PATENT DOCUMENTS 4,097,930 A * 7/1978 Bay ..... 2/10
5,469,584 A * 11/1995 Casartelli ..... 2/422
6,260,213 B1 * 7/2001 Eom et al. ..... 2/424

FOREIGN PATENT DOCUMENTS

FR 2629986 A1 * 10/1989 ..... A42B/3/00

* cited by examiner

*Primary Examiner*—Rodney M. Lindsey
(74) *Attorney, Agent, or Firm*—R. Neil Sudol; Henry D. Coleman; William J. Sapone

(57) ABSTRACT

A rotatable coupling structure for a shield and visor of a helmet includes a rotation shaft unit installed at both sides of the helmet body. The shield includes a rotary shaft inserted into a shaft hole in a circular rotation plate member through insertion guide portions at both ends. The visor includes a respective rotary shaft inserted into a shaft hole in the circular rotation plate member. The shield is coupled to the shaft hole of the respective rotary shaft and is rotatable upward and downward at multiple stage stop points, and the visor is assembled to the shaft of the rotary shaft and is fixed at a fixed position without an upward and downward rotation.

2 Claims, 7 Drawing Sheets

【Fig. 1】
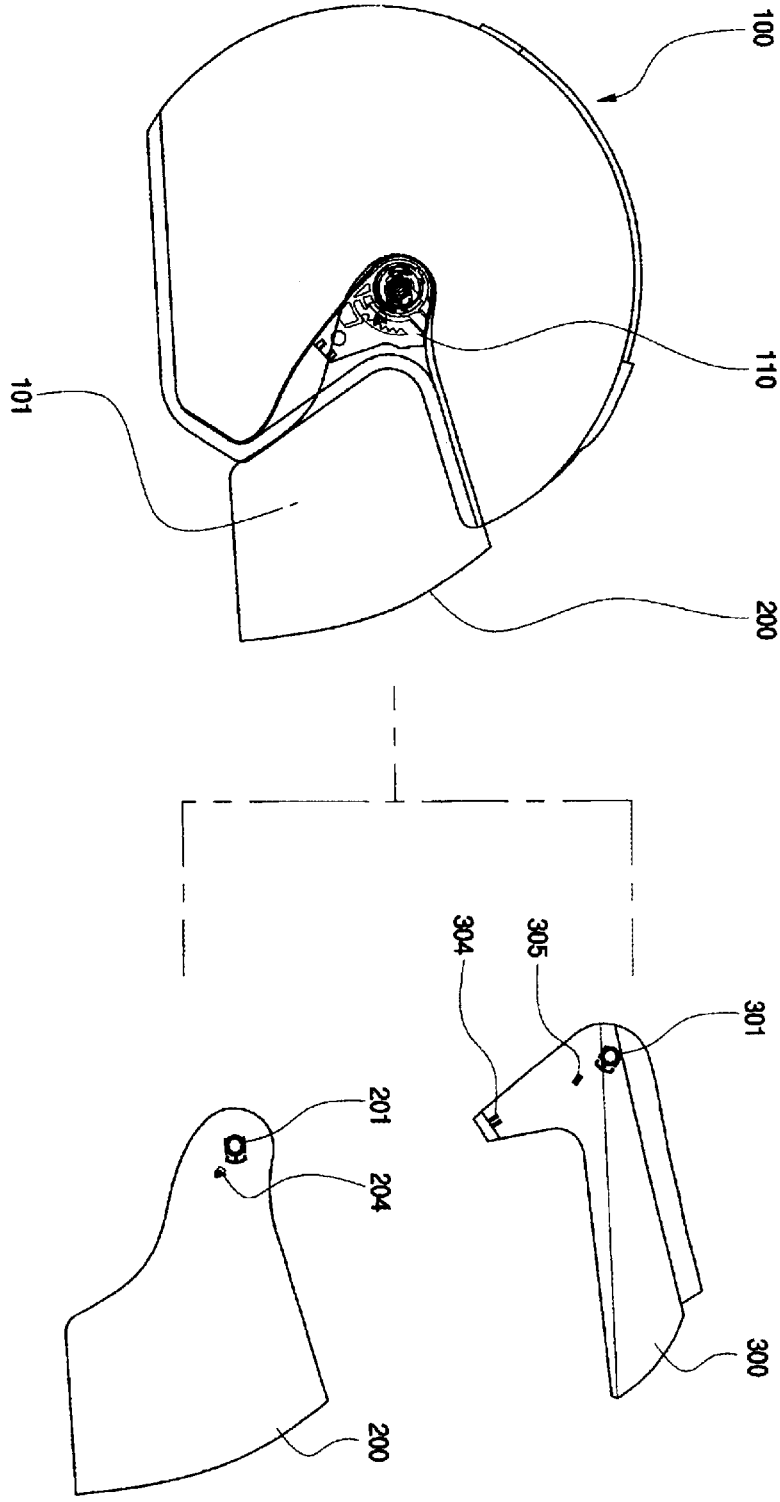

【Fig. 2】
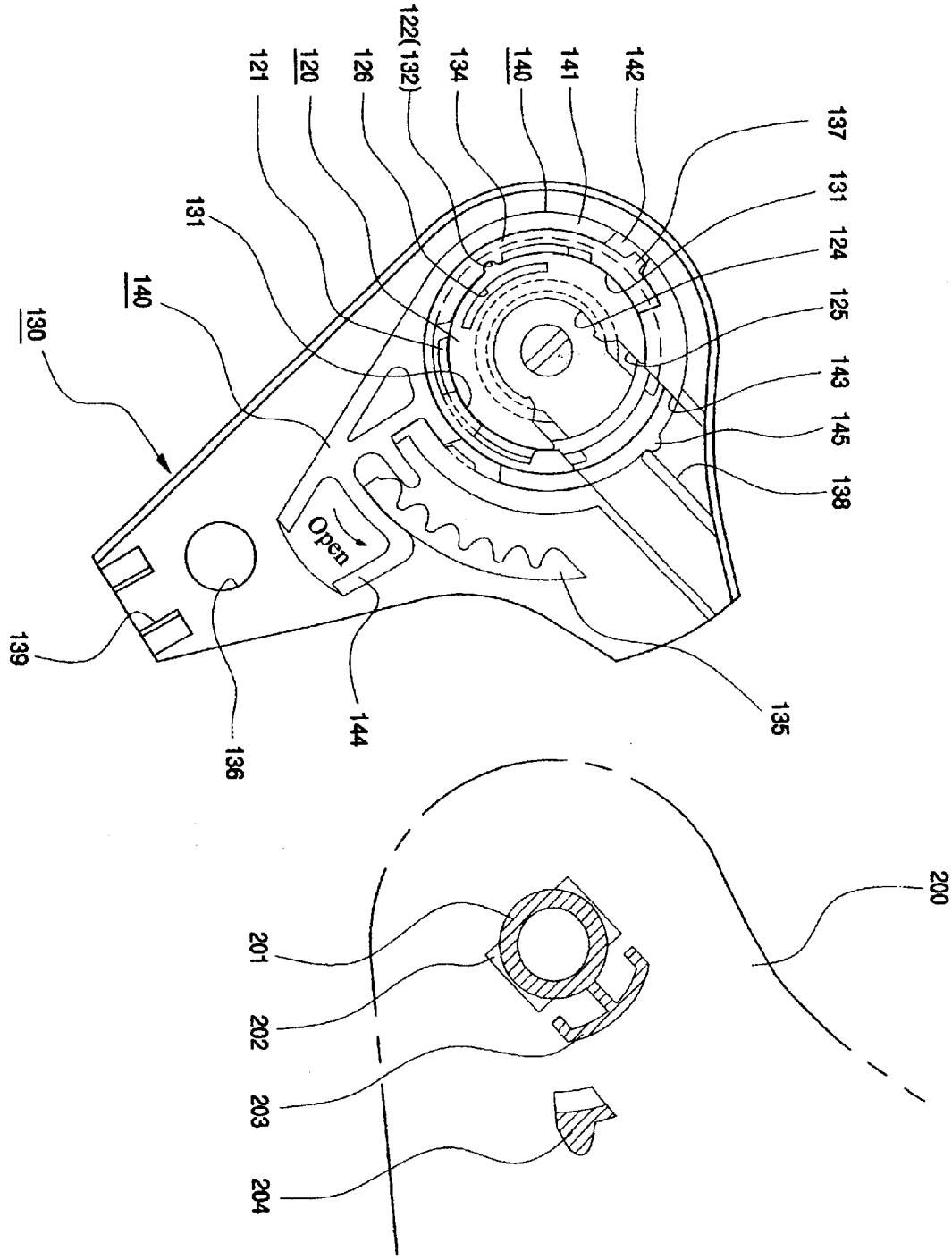

【Fig. 3】
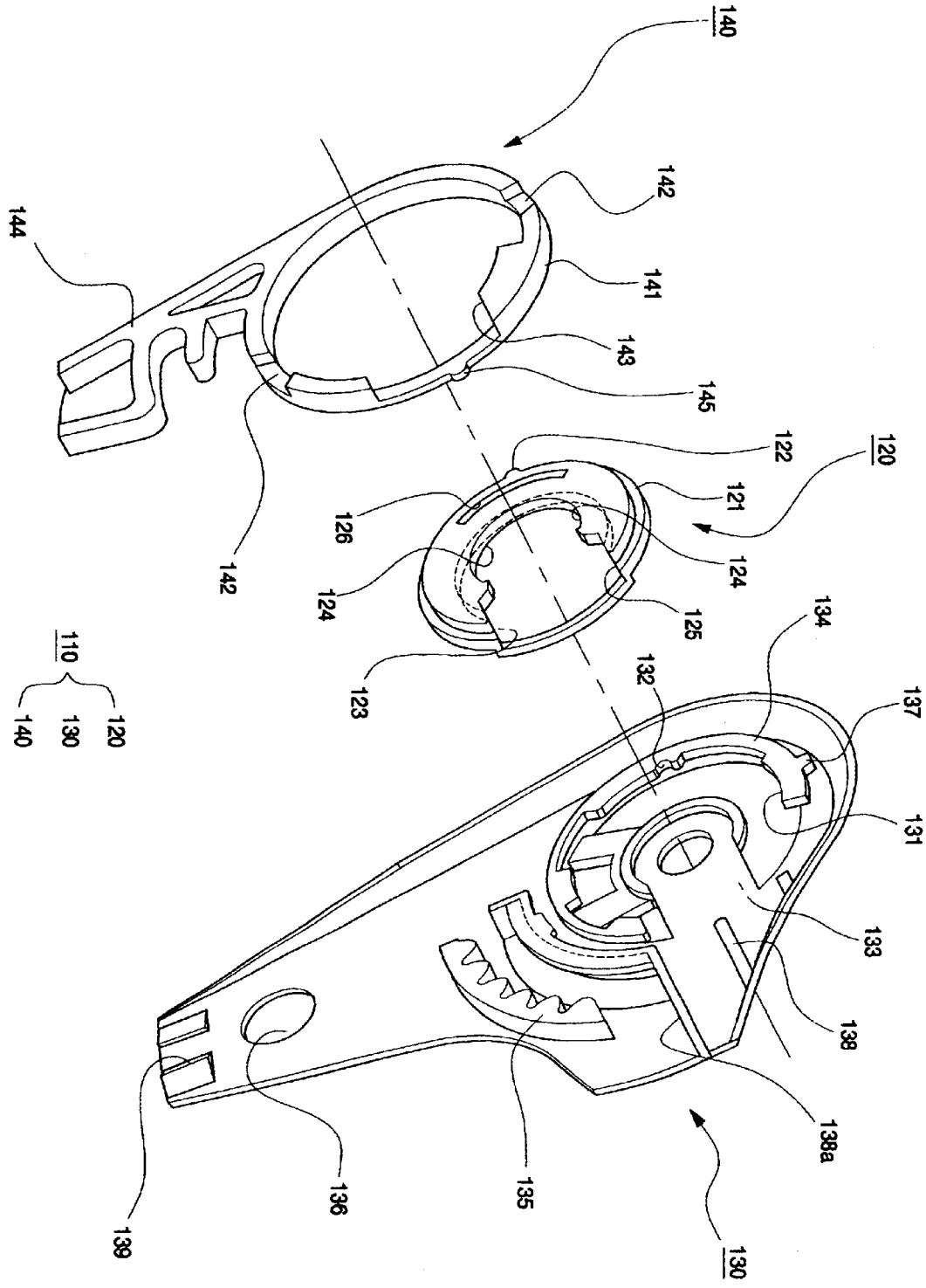

【Fig. 4】
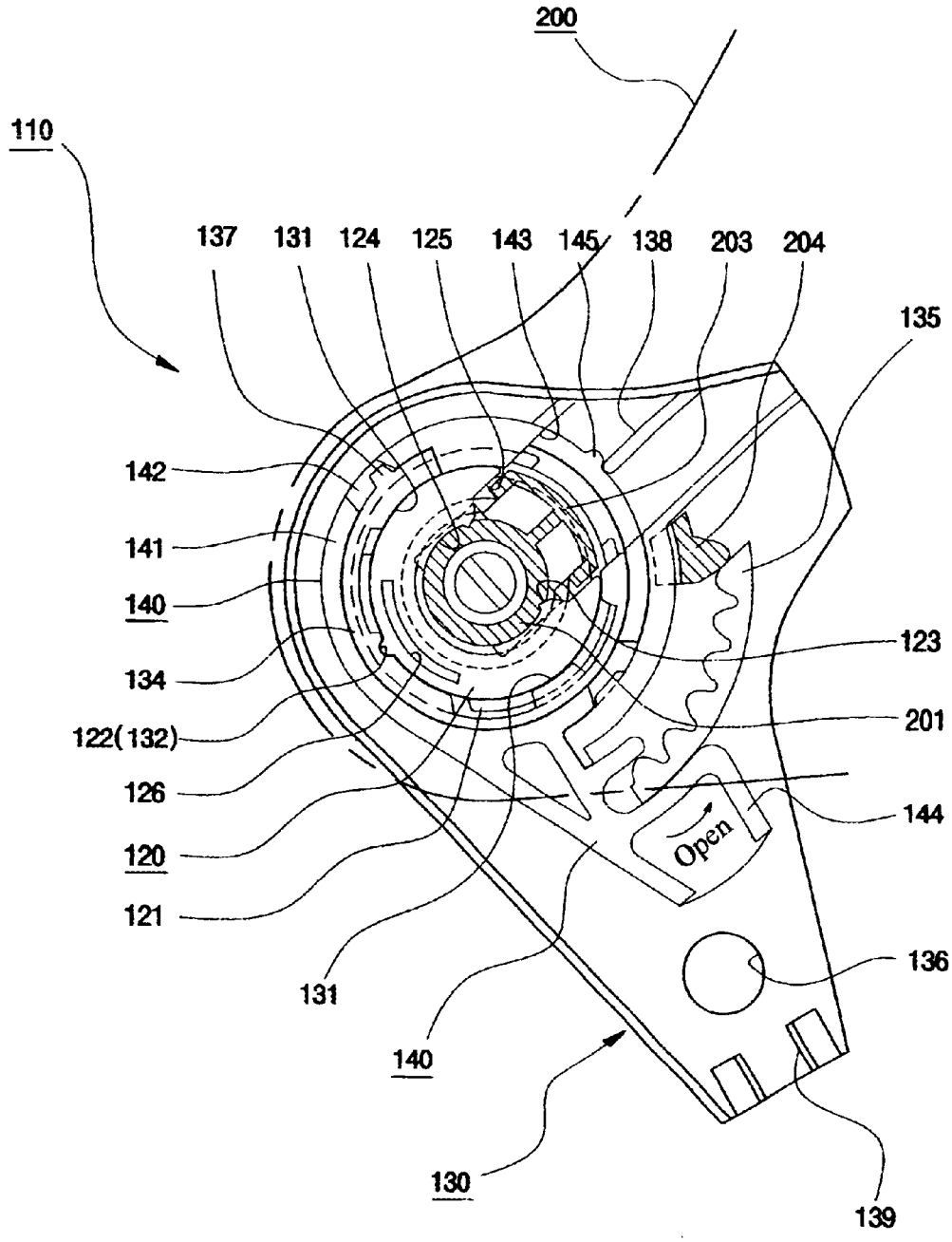

【Fig. 5】
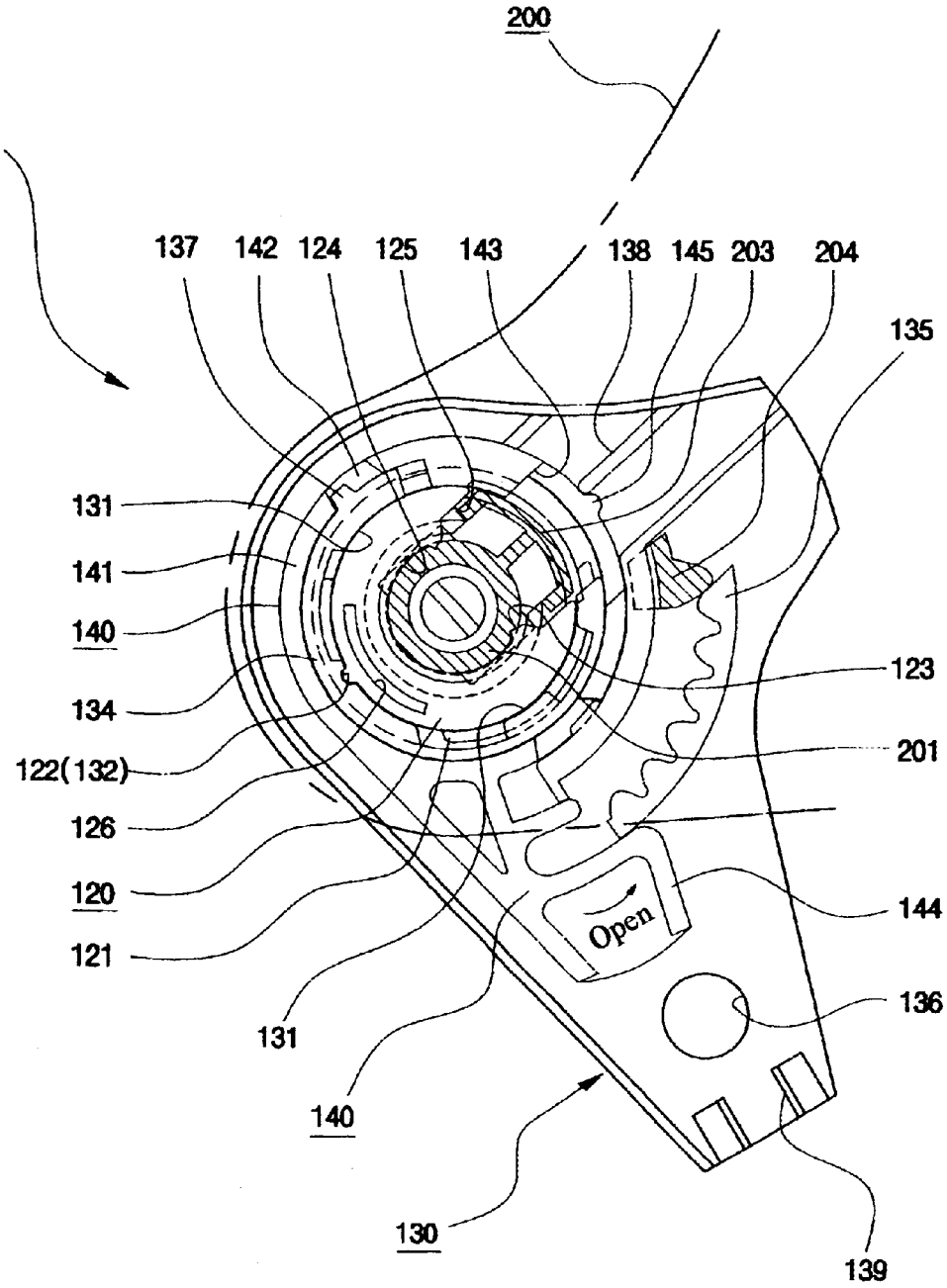

【Fig. 6】
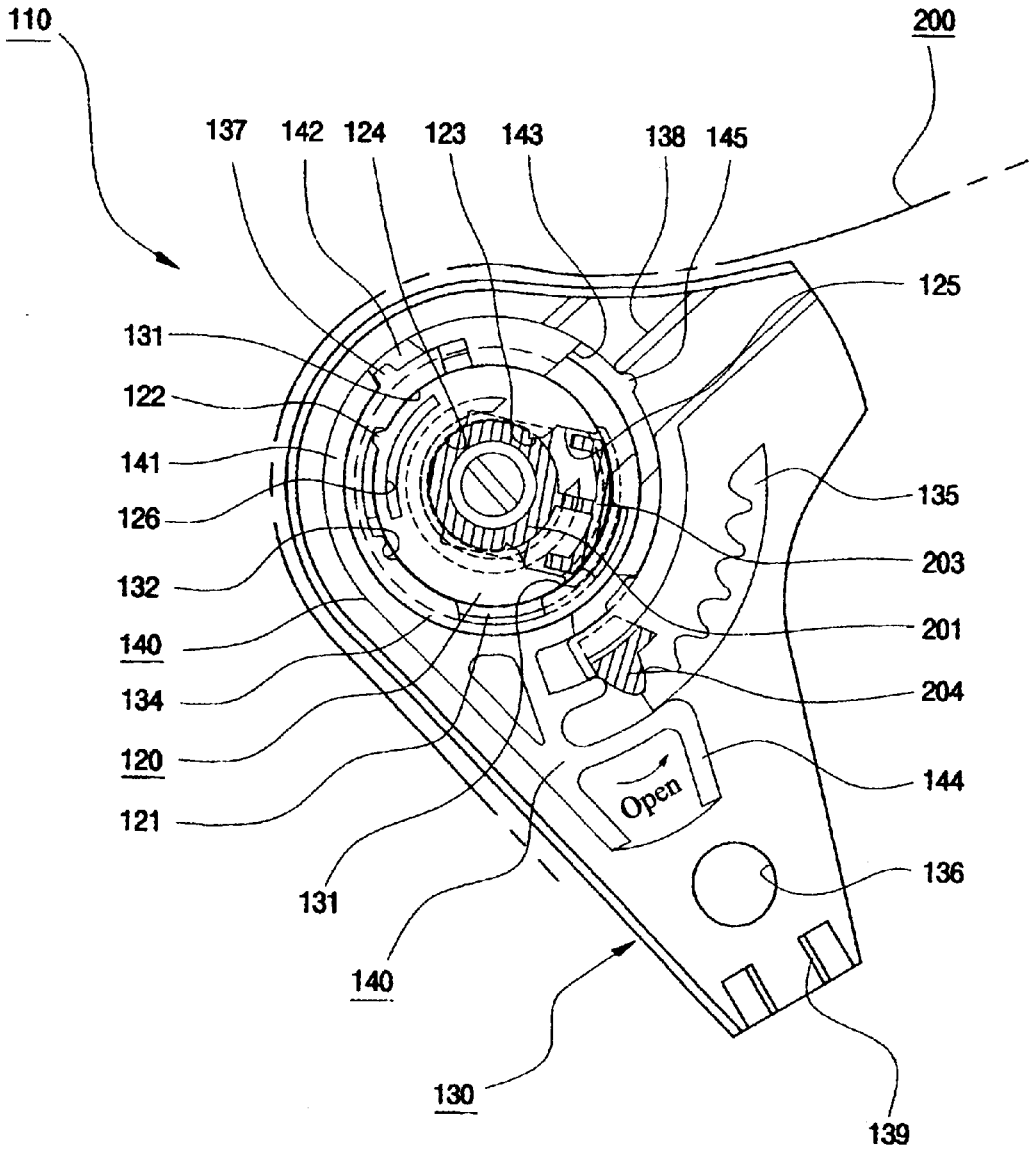

【Fig. 7】
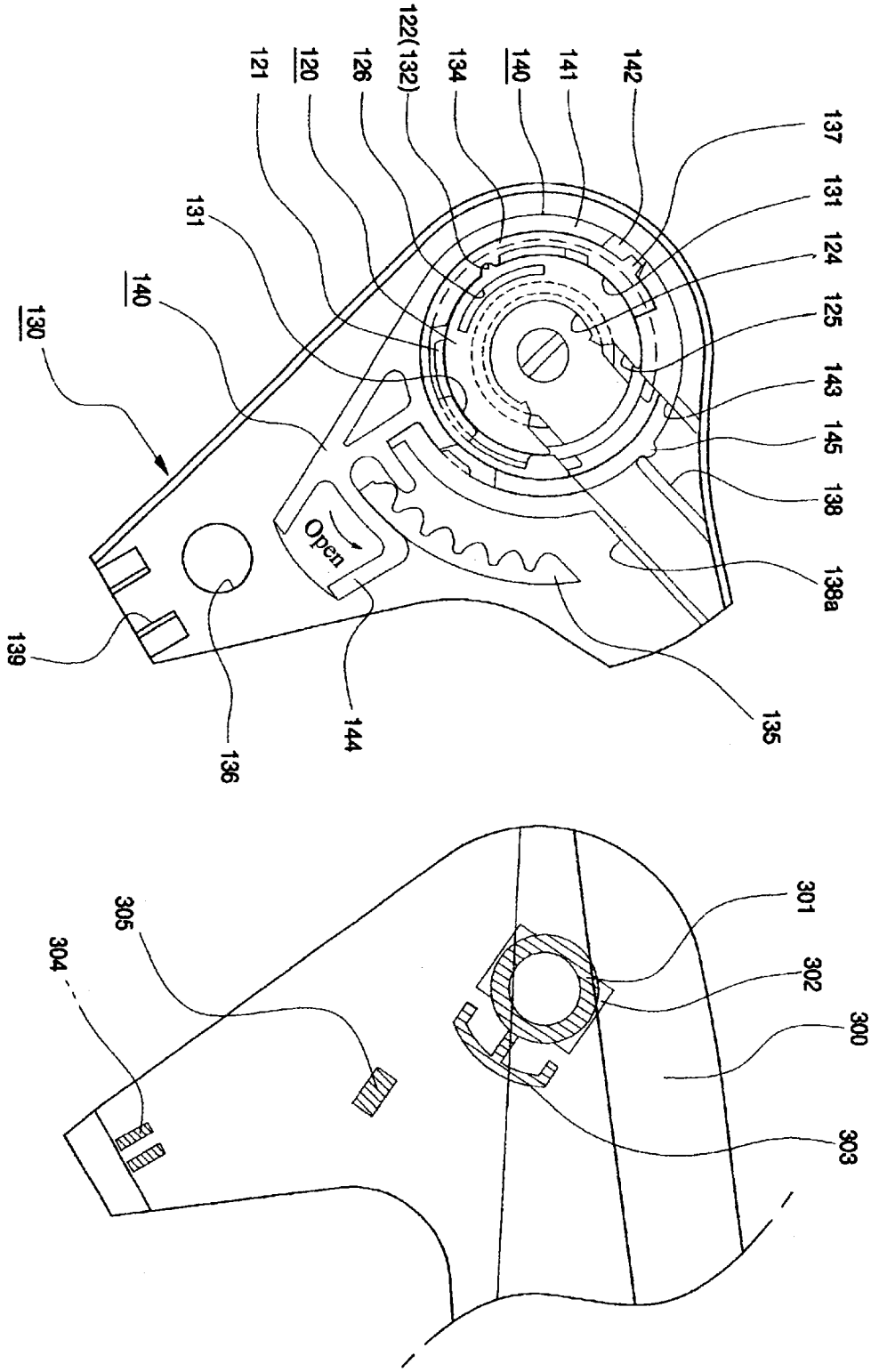

ROTATABLE COUPLING STRUCTURE FOR SHIELD AND VISOR OF HELMET

BACKGROUND OF THE INVENTION

1. Field of the Invention

The present invention relates to a coupling structure of a shield and visor of a helmet capable of protecting a user's head when riding a motorcycle, and in particular to a coupling structure of a shield and visor of a helmet in which a shield coupled in a front portion of a helmet is upwardly and downwardly rotatable by improving a conventional coupling structure, and a shield and visor are selectively assembled.

2. Description of the Background Art

Generally, when a person rides a two-wheeled vehicle, the person must wear a head protection helmet for protecting a rider's head. In the helmet, a shield or visor is coupled to a front portion of a helmet.

The above shield is capable of implementing a good field of vision which may be interfered by wind when a motorcycle runs in a forward direction. In addition, the shield is capable of preventing a breathing obstruction. The above visor is directed to preventing a sunlight from being incident into a field of vision of the user.

In the conventional shield coupling structure, a rotatable member is installed at both sides of the helmet. In a state that the both ends of the shield are coupled, an additional cover covers thereon and is fixed using a fixing bolt, etc. A rotation adjusting member having protrusions is formed in an inner lower portion of the shield, and the rotation adjusting member is coupled to a coupling member formed in the helmet for thereby performing an assembling operation. In a state that the shield is assembled, the shield or visor is opened and closed.

However, in the conventional coupling structure, when assembling the shield, in a state that one end of the shield is coupled to the rotation member installed at both sides of the helmet, the other end of the shield is coupled to the rotation member of the other side of the helmet. In this state, the fixing bolt is coupled to the rotation member for thereby installing the shield. Therefore, it is complicated for implementing an assembling work of the shield, and the workability is significantly decreased.

In addition, since the shield is generally installed in such a manner that the shield is rotatable in an upward and downward direction, the lifting and lowering operations of the shield may not be easily implemented based on the fixed state of the fixing member, and the fixed state of the shield may be loosened. In the case that the fixed state is bad, the shield may be disconnected from the helmet while using the helmet.

In order to overcome the above problems, the applicant of the present invention filed the Korean Patent application No. 1999-32362(hereinafter called as a prior art).

According to the above prior art, it is possible to secure a stable opening and closing operation of the shield installed in a front portion of the helmet, and an assembling procedure is simple, and a stable fixing state is obtained. A fixing member having an insertion rotation member and a locker is installed at both sides of the helmet. Therefore, it is possible to quickly and stably assemble the shield by simply inserting a coupling member of the shield into the fixing member. In addition, in the above cited prior art, it is possible to slightly open the shield.

However, the above cited prior art has the following disadvantages.

First, an open face type helmet(which does not include a jaw portion) needs a more simple shield coupling structure.

Second, the shield and visor are provided separately. Therefore, the shield and visor are selectively used.

Third, many users want to have a helmet having a visor which is not rotatable in an upward and downward directions, namely, is fixed separately from the shield. In this case, in the above prior art, it is impossible to meet the above user's demand.

SUMMARY OF THE INVENTION

Accordingly, it is an object of the present invention to provide a rotatable coupling structure for a shield and visor of a helmet which overcomes the problems encountered in the conventional art.

It is another object of the present invention to provide a rotatable coupling structure for a shield and visor of a helmet which is capable of implementing an easier manufacture and use by improving the coupling structure of a shield compared to the conventional art.

It is still another object of the present invention to provide a rotatable coupling structure for a shield and visor of a helmet which is capable of separately providing a shield and visor, so that it is possible to selectively assemble a shield and visor In order to achieve the above objects, there is provided a coupling structure of a shield and visor of a helmet in a helmet having a shield or a visor for opening and closing a front open portion of a body, which comprises a rotation shaft unit which is installed at both sides of the body and includes:

a base member which includes a plurality of outward protrusions which are formed in an outward direction; a plurality of inward shoulder portions formed in an inward direction; a stop groove formed in a certain portion; a circular protrusion having an insertion guide portion formed in one side; a locking shoulder portion formed in a bottom of an outer side; a guide latch shoulder portion formed in a lower portion of one side of the same; a guide pin stop shoulder portion formed therebetween; a plurality of coupling screw holes formed in a bottom, and a visor stopper formed in a lower portion of the same;

a rotation circular plate member which includes an outward flange portion which is formed in a part of an outer circumferential surface, in such a manner that the outward flange portion is inserted into the circular protrusion of the base member, namely, into a portion below the inward shoulder portion; a circular plate protrusion caught by a stop groove; an inward flange portion formed in an inner side of the shaft hole; and an inner insertion guide portion formed in one side of the same;

a locking member which includes a circular rim portion which is insertedly connected with an outer circumferential surface of the circular protrusion of the base member; an escape prevention groove formed on an upper surface of the circular rim portion; a locking protrusion formed on an outer circumferential surface of the circular rim portion; and a handle which is extended in a downward direction;

wherein the shield includes a shield rotary shaft which is inserted into a shaft hole of the rotation circular plate member through the insertion guide portions at both side ends in such a manner that a wing plate is caught by the inward flange portion; and a shield protrusion shoulder portion formed in one side of the same in such a manner that the shield protrusion shoulder portion is caught by the guide latch shoulder portion;

wherein the visor includes a visor rotary shaft which is inserted into a shaft hole of the rotation circular plate member through the insertion guide portions at both side ends in such a manner that a wing plate is caught by the inward flange portion, a guide pin formed in one side of the same, and a visor stop protrusion caught by the visor stopper formed in a lower portion of the same; and wherein the shield is assembled to the shaft hole of the rotary shaft and is rotatable based on multiple stage stop points, and the visor is assembled to the shaft of the rotary shaft and is fixed at a fixed position without an upward and downward rotation in such a manner that the visor stop protrusion is caught by the visor stopper.

BRIEF DESCRIPTION OF THE DRAWINGS

The present invention will become better understood with reference to the accompanying drawings which are given only by way of illustration and thus are not limitative of the present invention, wherein;

FIG. 1 is a side view illustrating the whole construction of an assembled state of a helmet and shield according to the present invention;

FIG. 2 is a side view illustrating a disassembled state of a rotation shaft unit and a shield according to the present invention;

FIG. 3 is a disassembled perspective view illustrating the important elements of the present invention;

FIG. 4 is a side view illustrating an assembled state according to the present invention;

FIG. 5 is a side view illustrating a state that a locking member is filled after an assembling operation is completed according to the present invention;

FIG. 6 is a side view illustrating an operation state according to the present invention; and FIG. 7 is a side view illustrating a state before a visor is coupled according to the present invention.

DETAILED DESCRIPTION OF THE PREFERRED EMBODIMENTS

The constructions and operations of the present invention will be explained with reference to the accompanying drawings.

FIG. 1 is a side view illustrating the whole construction of an assembled state of a helmet and shield according to the present invention, FIG. 2 is a side view illustrating a disassembled state of a rotation shaft unit and a shield according to the present invention, and FIG. 3 is a disassembled perspective view illustrating the important elements of the present invention.

As shown in FIG. 1, a helmet according to the present invention includes a shield 200 for opening and closing a front opening portion 101 of a body 100, and a visor 300 which is used in exchange with the shield 200.

A rotation shaft unit 110 is formed at both sides of the body 100, and a rotary shaft is installed in the inner sides of both ends of the shield 200 and the visor 300 for thereby being assembled to the rotation shaft unit 110.

The rotation shaft unit 110 includes a base member 130, a rotation circular plate member 120, and a locking member 140.

The base member 130 includes a plurality of outward protrusions 137 formed in an outer direction, a plurality of inward shoulder portions 131 formed in an inner direction, a stop groove 132 formed in a certain portion, a circular protrusion 134 having an insertion guide portion 133 in one side, a locking shoulder portion 138 formed in the bottom of the outer side, a guide latch shoulder portion 135 formed below one side, a guide pin stop shoulder portion **138*a* formed therebetween, a plurality of coupling screw holes 136 formed in the bottom, and a visor stopper 139** formed therebelow.

The rotation circular plate member 120 includes an outward flange portion 121 formed in a part of the outer surface in such a manner that the flange portion 121 is inserted into a circular protrusion 134 of the base member 130, namely, into a portion below the inward shoulder portion 131, a circular plate protrusion 122 coupled to the stop groove 132, a shaft hole 123 formed in the center portion, an inward flange portion 124 formed in an inner side of the shaft hole 123, and an inner insertion guide portion 125 formed in one side of the same.

The locking member 140 includes a circular rim portion 141 inserted onto and connected with an outer surface of the circular protrusion portion 134 of the base member 130, an escape prevention groove 142 formed in an upper surface of the circular rim portion 141, a locking protrusion 145 formed in an outer surface of the circular rim portion, and a handle 144 which is extended in a downward direction.

The base member 130, the rotation circular plate member 120 and the locking member 140 are assembled based on the procedure shown in FIG. 3.

The rotation circular plate member 120 is prevented from being escaped in such a manner that the outward flange portion 121 formed in the outer circumferential portion is inserted into a portion below the inward shoulder portion 131 formed in the circular plate protrusion 134. In addition, the rotation circular plate member 120 becomes rotatable in such a manner that the circular plate protrusion 122 formed in the outer circumferential portion is connected with the stop groove 132 or escaped therefrom.

The locking member 140 is not escaped in such a manner that the outward protrusion 137 of the circular protrusion 134 is assembled to be placed on the escape prevention groove 142 formed on the upper surface of the same and has an opened state in such a manner that the locking protrusion 145 formed in the outer circumferential surface is coupled with the locking shoulder portion 138 formed in the bottom.

Namely, when the locking protrusion 145 is moved in a lower direction of the locking shoulder portion 138, the insertion guide portion 133 of the locking member 140 and the inner insertion guide portion 125 of the rotation circular plate member 120 are matched and opened, and when the locking protrusion 145 is moved in an upper direction of the locking shoulder portion 138, the insertion guide portion 133 of the locking member 140 and the inner insertion guide portion 125 of the rotation circular plate member 120 are mismatched and closed.

The shield 200 includes a shield rotary shaft 201 which is inserted into the shaft hole 123 of the rotation circular plate member 120 through the insertion guide portions at side ends in such a manner that a wing plate 202 is coupled with the inward flange portion 124, and a shield protrusion portion 204 coupled with the latch shoulder portion 135 at one side.

The visor 300 includes a visor rotation shaft 301 which is inserted into the shaft hole 123 of the rotation circular plate member 120 through the insertion guide portions at both side ends in such a manner that the wing plate 302 is coupled with the inward flange portion 124, a guide pin 305 formed at one side, and a visor stop protrusion 304 caught by the visor stopper 139 at a lower side.

In the drawings, reference numeral 203 represents a movement prevention circular portion of the shield, and reference numeral 303 represents a movement prevention circular portion of the visor.

The assembling and disassembling procedures of the present invention will be explained with reference to the accompanying drawings.

Here, since the constructions of the rotary shafts of the shield 200 and the visor 300 are same, the assembling and disassembling procedures of the same are similar.

First, the assembling and disassembling procedures of the shield will be explained. As shown in FIG. 4, the locking member 140 is rotated in the counterclockwise direction, so that the insertion guide portion 133 of the locking member 140 and the inner insertion guide portion 125 of the rotation circular plate member 120 are matched.

In the thusly matched state, since the widths of the insertion guide portion 133 and the inner insertion guide portion 125 are matched, and the above width is matched with the shield rotary shaft 201 of the shield 200, the rotary shaft 201 is inserted therein, so that the wing plate 202 is assembled into a portion below the inward flange portion 124 of the rotation circular plate member 120 for thereby implementing an assembling procedure.

In the thusly assembled state, the movement prevention circular portion 203 of the shield rotary shaft 201 is matched with the outer diameter of the rotation circular plate member 120. In this state, when the locking member 140 is rotated in the clockwise direction, as shown in FIG. 5, the insertion guide portion 133 of the locking member 140 and the inner insertion guide portion 125 of the rotation circular plate member 120 are mismatched, so that the shield rotary shaft 201 is not escaped to the outside.

Therefore, the shield 200 is not escaped in a longitudinal direction of the shaft in such a manner that the wing plate 202 of the shield rotation shaft 201 is inserted into the inner flange portion 124 of the rotation circular plate member 120 and is not escaped in a circumferential direction of the shaft by the locking member 140.

Therefore, the shield protrusion shoulder portion 204 formed in the inner side surface of the shield 200 is caught by the guide latch shoulder portion 135 of the base member 130, so that the shield protrusion shoulder portion 204 becomes rotatable at a fixed position in a multiple stage structure.

Therefore, the optimum position is obtained in such a manner that the circular plate protrusion 122 of the rotary circular plate member 120 is not downwardly slid when the circular plate protrusion 122 of the rotation circular plate member 120 reaches at the stop groove 132 of the circular protrusion 134.

On the contrary, the disassembling operation of the shield 200 is performed in the reverse sequence of the above-described assembling procedure.

Namely, as shown in FIG. 5, the locking member 140 is rotated in the counterclockwise direction, and then the insertion guide portion 133 of the locking member 140 and the inner insertion guide portion 125 of the rotation circular plate member 120 are matched, and the shield rotary shaft 201 is escaped through the insertion guide portion 133 and the inner insertion guide portion 125.

First, the assembling and disassembling procedures of the visor 300 will be explained. As shown in FIG. 4, the locking member 140 is rotated in the counterclockwise direction, and then the insertion guide portion 133 of the locking member 140 and the inner insertion guide portion 125 of the rotation circular plate member 120 are matched.

In the thusly matched state, the widths of the insertion guide portion 133 and the inner insertion guide portion 125 are same. Since the above width is the same as the visor rotary shaft 301 of the visor 300, the rotary shaft 301 is inserted thereinto, so that the wing plate 302 is inserted into a portion below the inward flange portion 124 of the rotation circular plate member 120 for thereby implementing an assembling procedure.

In the thusly assembled state, the movement prevention circular portion 303 of the visor rotary shaft 301 is matched with the outer diameter of the rotation circular plate portion 120. In the case of the visor 300, since the visor rotation shaft 301 is already rotated so that the visor stop protrusion 304 is caught by the visor stopper 139 without rotating the locking member 140, differently from the shield 200, the visor 300 is not escaped to the outside, so that the visor 300 is not moved in an upward and downward directions and is fixed at a fixed position.

On the contrary, when disassembling the visor 300, the portion in which the visor stop protrusion 304 is formed, is slightly lifted, so that the visor stop protrusion 304 is escaped from the visor stopper 139 for thereby upwardly lifting the visor 300. Here, the visor 300 is upwardly lifted in such a manner that the guide pin 305 formed in one side of the visor rotary shaft 301 is caught by the guide pin stop shoulder portion 138*a* of the base member 130, so that the visor rotation shaft 301 is easily escaped from the rotation circular plate member 120. Therefore, the visor 300 is easily escaped through the insertion guide portion 133 and the inner insertion guide portion 125 in the same method as the method for escaping the shield 200.

As described above, the assembling and disassembling procedures of the visor 300 are similar with the assembling and disassembling procedures of the shield 200. The visor 300 and the shield 200 may be easily exchanged.

Accordingly, the coupling structure of a shield and visor of a helmet according to the present invention is well adapted to an open face type helmet which does not include a jaw portion. The construction of the shield rotary shaft(and the visor rotary shaft) is simple based on a decreased number of parts by improving the shield coupling structure of the cited prior art, so that it is possible to implement an easier assembling and disassembling procedure. In addition, it is possible to selectively use the shield and visor based on an easier assembling and disassembling procedures.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a helmet having a shield or a visor for opening and closing a front open portion of a body, a coupling structure of a shield and visor of a helmet, comprising:

a rotation shaft unit which is installed at both sides of the body, said rotation shaft unit including:

a base member which includes a plurality of outward protrusions which are formed in an outward direction; a plurality of inward shoulder portions formed in an inward direction; a stop groove formed in a certain portion; a circular protrusion having an insertion guide portion formed in one side; a locking shoulder portion formed in a bottom of an outer side; a guide latch shoulder portion formed in a lower portion of one side of the same; a guide pin stop shoulder portion formed therebetween; a plurality of coupling screw holes formed in a bottom, and a visor stopper formed in a lower portion of the same;

a rotation circular plate member which includes an outward flange portion which is formed in a part of an outer circumferential surface, in such a manner that the outward flange portion is inserted into the circular protrusion of the base member, namely, into a portion below the inward shoulder portion; a circular plate protrusion caught by a stop groove; an inward flange portion formed in an inner side of the shaft hole; and an inner insertion guide portion formed in one side of the same;

a locking member which includes a circular rim portion which is insertedly connected with an outer circumferential surface of the circular protrusion of the base member; an escape prevention groove formed on an upper surface of the circular rim portion; a locking protrusion formed on an outer circumferential surface of the circular rim portion; and a handle which is extended in a downward direction;

wherein said shield includes a shield rotary shaft which is inserted into a shaft hole of the rotation circular plate member through the insertion guide portions at both side ends in such a manner that a wing plate is caught by the inward flange portion; and a shield protrusion shoulder portion formed in one side of the same in such a manner that the shield protrusion shoulder portion is caught by the guide latch shoulder portion;

wherein said visor includes a visor rotary shaft which is inserted into a shaft hole of the rotation circular plate member through the insertion guide portions is at both side ends in such a manner that a wing plate is caught by the inward flange portion, a guide pin formed. in one side of the same, and a visor stop protrusion caught by the visor stopper formed in a lower portion of the same; and wherein said shield rotary shaft is assembled to the shaft hole of said rotation circular plate member so that said shield is rotatable based on multiple stage stop points, and said visor rotary shaft is assembled to the shaft hole of said rotation circular plate member so that said visor is fixed at a fixed position without an upward and downward rotation in such a manner that the visor stop protrusion is caught by the visor stopper.

2. The structure of claim 1, wherein said shield and visor include rotary shafts, wing plates and movement prevention circular portions, so that the shield and visor are assembled to the rotary shaft of the body of the helmet, respectively, whereby the shield and visor are selectively assembled.

* * * * *